United States Patent [19]

Maekawa et al.

[11] Patent Number: 4,618,575

[45] Date of Patent: Oct. 21, 1986

[54] SILVER HALIDE PHOTOGRAPHIC LIGHT-SENSITIVE MATERIAL

[75] Inventors: Yukio Maekawa; Yasuo Mukunoki, both of Kanagawa, Japan

[73] Assignee: Fuji Photo Film Co., Ltd., Kanagawa, Japan

[21] Appl. No.: 719,396

[22] Filed: Apr. 3, 1985

[30] Foreign Application Priority Data

Apr. 3, 1984 [JP] Japan ..... 59-66465

[51] Int. Cl.[4] ..... G03C 1/38

[52] U.S. Cl. ..... 430/634; 430/635; 430/636; 430/631

[58] Field of Search ..... 430/634, 635, 636, 611, 430/609, 631; 252/354, 355; 106/308 Q:308 S

[56] References Cited

U.S. PATENT DOCUMENTS

| | | | |
|---|---|---|---|
| 3,201,252 | 8/1965 | Knox et al. | 430/634 |
| 4,069,244 | 1/1978 | Mueller | 252/355 |
| 4,444,876 | 4/1984 | Maekawa et al. | 430/636 |

*Primary Examiner*—Won H. Louie

*Attorney, Agent, or Firm*—Sughrue, Mion, Zinn, Macpeak & Seas

[57] ABSTRACT

A silver halide photographic light-sensitive material is described, comprising a hydrophilic organic colloid layer, wherein the hydrophilic organic colloid layer contains at least one compound represented by

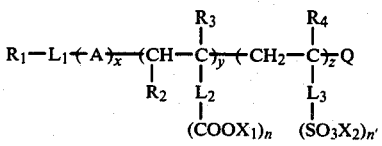

(I)

wherein $R_1$ represents a substituted or unsubstituted alkyl or aromatic group;

$R_2$ represents a hydrogen atom or

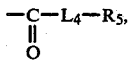

wherein $L_4$ represents a divalent bonding group, and $R_5$ represents a hydrogen atom or a substituted or unsubstituted alkyl or aromatic group;

$R_3$ and $R_4$ each represents a hydrogen atom, or a substituted or unsubstituted alkyl group;

$L_1$ represents a divalent bonding group;

$L_2$ and $L_3$ each represents a single bond or a divalent or trivalent bonding group;

n and n' each represents an integer of 1 or 2;

A represents a repeating unit resulting from polymerization of an ethylenically unsaturated monomer copolymerizable with monomers constituting the units

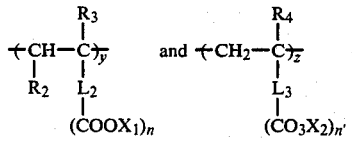

wherein $X_1$ and $X_2$ each represents a hydrogen atom or a cation;

x, y, and z are each an average number of units derived from respective monomers; and Q represents a monovalent group.

14 Claims, No Drawings

SILVER HALIDE PHOTOGRAPHIC LIGHT-SENSITIVE MATERIAL

FIELD OF THE INVENTION

The present invention relates to a photographic light-sensitive material. More particularly, it relates to a silver halide photographic light-sensitive material containing coating aids in a hydrophilic organic colloid layer thereof and also to a process for producing the above light-sensitive material.

BACKGROUND OF THE INVENTION

Examples of supports generally used for photographic light-sensitive materials include films or sheets of cellulose esters, synthetic polymers such as polystyrene, polycarbonate, and polyethylene terephthalate, glass, paper, and α-olefin-coated paper. At least one silver halide photographic emulsion layer is coated, directly or through a subbing layer, on the support. With many light-sensitive materials, to prevent them from being scratched or damaged when they come into contact with each other or with different light-sensitive materials, or during the processing thereof, a surface protective layer is coated on the photographic emulsion layer. In addition, other layers are coated of gelatin, other hydrophilic colloids, or vinyl polymer latexes, containing various additives such as dyes, antistatic agents, hardening agents, color-forming couplers, and anti-halation agents, for example, an anti-halation layer, an inter layer, a filter layer, and an antistatic layer.

Ordinary photographic light-sensitive materials typically comprise many hydrophilic organic colloid layers coated on the support. In the production of such light-sensitive materials, it is necessary that coating solutions forming the colloid layers be coated in a thin layer form, uniformly and at high speed, without causing any coating troubles such as repelling. In many cases, these coating solutions are coated at the same time; that is, simultaneous multi-layer coating is employed. For example, a color photographic light-sensitive material is produced by continuously coating photographic emulsion layers having different light-sensitive regions. Coating gelatin or colloid solutions onto a colloid layer of gelatin, while satisfying the necessary coating characteristics is, for example, more difficult than direct coating of gelatin or colloid solutions on the support. Such coating is particularly difficult when the colloid layer previously coated on the support is in the condition that it is cooled just after being coated.

In the production of color photographic light-sensitive materials, additives that are sparingly soluble in water, such as color couplers, ultraviolet absorbers, and brightening agents, are typically dissolved in high boiling organic solvents such as phthalates and phosphates, and thereafter dispersed or emulsified in hydrophilic organic colloids, particularly a gelatin solution in the presence of surface active agents, to prepare a coating composition for forming a hydrophilic organic colloid layer. In this case, if the amount of the surface active agent to be used as an emulsifying agent is too large, it becomes more difficult to coat another hydrophilic organic colloid layer on the earlier-prepared hydrophilic organic colloid layer. If, on the other hand, it is too small, the photographic light-sensitive material obtained has unstable photographic characteristics.

Various anionic surface active agents have been used as coating aids for coating solutions to be used in the production of photographic light-sensitive materials. Typical examples of such anionic surface active agents are described in U.S. Pat. Nos. 2,240,476, 3,026,202, 3,068,101, 3,220,847, 3,415,649, West German Pat. No. 1,942,665, etc.

These anionic surface active agents, however, have a disadvantage in that when added to a gelatin coating solution, they are readily precipitate as solid hydrates, thereby seriously reducing the coating properties of the gelatin coating solution, because the solubilities of the anionic surface active agents are significantly decreased by alkaline earth metal ions such as calcium contained in gelatin.

Japanese Patent Application (OPI) No. 98235/79 discloses that if alkaline earth metal salts of certain anionic surface active agents with ethylene oxide introduced thereinto are used, the resulting gelatin coating solution has good coating properties even if it contains alkaline earth metal ions such as calcium ions (the term "OPI" as used herein means a "published unexamined Japanese patent application"). The presence of the alkaline earth metal salts of anionic surface active agent reduces coating problems such as "repelling", and permit the production of a gelatin coating solution having somewhat better coating properties than those obtained using conventional anionic surface active agents. However, such coating solution fail to satisfy high speed-coating properties that have come to be required in the production of silver halide light-sensitive materials in recent years.

SUMMARY OF THE INVENTION

One object of the present invention is to provide a photographic light-sensitive material in which repelling as encountered in coating a gelatin-containing solution or other hydrophilic colloid solution onto a support such as a film or paper, or onto another photographic layer, can be prevented, and coating characteristics such as uniformity are improved.

Another object of the present invention is to provide a method which enables coating a photographic emulsion or other hydrophilic colloid composition at high speed without the occurrence of coating problems such as formation of bubbles and repelling.

Still another object of the present invention is to provide a method whereby additional hydrophilic organic colloid layers containing photographic additives that are only sparingly soluble in water dissolved in a high boiling organic solvent can be easily coated on a first hydrophilic organic colloid layer.

It has now been found that the objects of the present invention can be attained by coating a hydrophilic organic colloid coating solution containing at least one compound represented by formula (I) as described below, singly or simultaneously with coating solutions having different compositions, to form a hydrophilic organic colloid layer containing the compound represented by formula (I).

Thus, the present invention relates to a silver halide photographic light-sensitive material comprising a hydrophilic organic colloid layer, wherein the hydrophilic organic colloid layer contains at least one compound represented by formula (I)

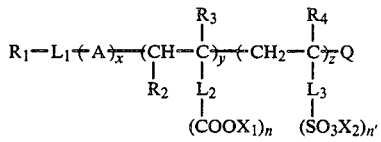

(I)

wherein $R_1$ represents a substituted or unsubstituted alkyl or aromatic group;

$R_2$ represents a hydrogen atom or

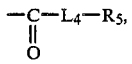

wherein $L_4$ represents a divalent bonding group, and $R_5$ represents a hydrogen atom or a substituted or unsubstituted alkyl or aromatic group;

$R_3$ and $R_4$ each represents a hydrogen atom, or a substituted or unsubstituted alkyl group;

$L_1$ represents a divalent bonding group;

$L_2$ and $L_3$ each represents a single bond or a divalent or a trivalent bonding group;

n and n' each represents an integer of 1 or 2;

A represents a repeating unit resulting from polymerization of an ethylenically unsaturated monomer copolymerizable with monomers constituting the units

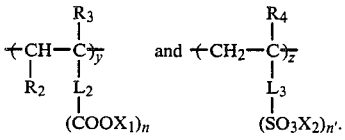

wherein $X_1$ and $X_2$ each represents a hydrogen atom or a cation;

x, y, and z are each an average number of units derived from respective monomers; and Q represents a monovalent group.

DETAILED DESCRIPTION OF THE INVENTION

The term "repelling" as used herein refers to the phenomenon wherein, during the formation of a hydrophilic organic colloid layer, minute areas are formed which remain uncoated with a coating solution; although the exact reason for this is not clear, it is believed to occur due to characteristics such as the wetting and surface tension of the coating solution.

The compounds of formula (I) will hereinafter be explained in detail.

In formula (I)

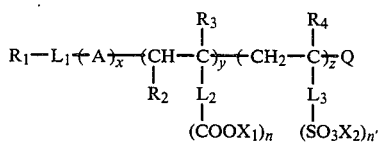

(I)

$R_1$ represents a substituted or unsubstituted alkyl or aromatic group;

$R_2$ represents a hydrogen atom or a group represented by the formula

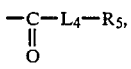

wherein $L_4$ represents a divalent bonding group, and $R_5$ represents a hydrogen atom, or a substituted or unsubstituted alkyl or aromatic group:

$R_3$ and $R_4$ which may be the same or different, each represents a hydrogen atom, or a substituted or unsubstituted alkyl group;

$L_1$ represents a divalent bonding group;

$L_2$ and $L_3$ each represents a single and or a di- or a trivalent bonding group;

n and n' each represents an integer of 1 or 2;

A represents a repeating unit resulting from copolymerization of an ethylenically unsaturated monomer copolymerizable with monomers constituting the units.

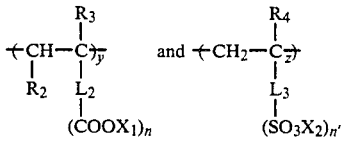

wherein $X_1$ and $X_2$ each represents (i.e., are independently) a hydrogen atom or a cation, x, y, and z are each an average number of units derived from respective monomers; and Q represents a monovalent group.

Of the compounds represented by formula (I), the following are preferred.

In formula (I), $R_1$ preferably a substituted or un-substituted alkyl group having from 8 to 20 carbon atoms, or a group represented by formula (III)

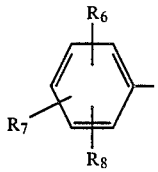

(III)

wherein $R_6$ and $R_7$, which may be the same or different, each represents a hydrogen atom, a halogen atom, a substituted or unsubstituted alkyl group having from 1 to 12 carbon atoms, or an alkoxyl group having from 1 to 10 carbon atoms, and $R_8$ represents a hydrogen atom or a group represented by formula (IV).

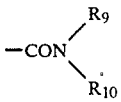

(IV)

wherein $R_9$ and $R_{10}$ each represents (i.e., are independently) a hydrogen atom or a substituted or unsubstituted alkyl group having from 6 to 18 carbon atoms, or $R_9$ and $R_{10}$ together combine to form a nitrogen-containing ring.

More preferred are those compounds in which $R_1$ represents an alkyl group having from 8 to 12 carbon atoms, a group represented by formula (V)

(V)

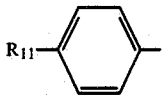

wherein $R_{11}$ represents an alkyl group having from 8 to 12 carbon stoms, a group represented by formula (VI)

(VI)

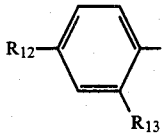

wherein $R_{12}$ and $R_{13}$, which may be the same or different, each represents an alkoxyl group having from 4 to 8 carbon atoms, or a group represented by formula (VII)

(VII)

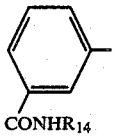

wherein $R_{14}$ represents an alkyl group having from 8 to 18 carbon atoms.

$L_1$ is a divalent bonding group. Particularly preferred are —S— and —$SO_2$—.

A is a repeating unit resulting from polymerization of an ethylenically unsaturated monomer copolymerizable with monomers forming the other repeating units shown in formula (I). Typical examples of monomers constituting such repeating units are alkylene such as ethylene, propylene, 1-butene, and isobutene, styrene, α-methylstyrene, vinyltoluene, ethylenically unsaturated esters of fatty acids (e.g., vinyl acetate and allyl acetate), mono- or di-carboxylic acid esters of ethylenically unsaturated monomers (e.g., methyl methacrylate, methyl acrylate, ethyl acrylate, n-butyl acrylate, n-butyl methacrylate, n-octyl acrylate, and benzyl acrylate), substituted monoethylenically unsaturated compounds (e.g., acrylonitrile), and dienes (e.g., butadiene and isoprene). Particularly preferred are acrylonitrile, styrene, vinyl acetate, methyl methacrylate, methyl acrylate, n-butyl acrylate, and n-octyl acrylate. A may be formed by two or more of the above-described monomers.

Hereinafter, for convenience, the unit comprising A is referred to as Component X. The units

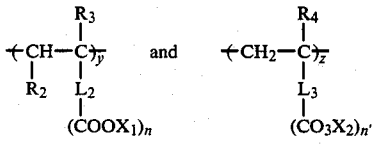

(Component Y) (Component Z)

are referred to as Components Y and Z, respectively.

Component Y is a repeating unit resulting from copolymerization of an ethylenically unsaturated monomer copolymerizable with the monomers constituting Components X and Z. It may contain two or more monomers.

$R_2$ preferably represents a hydrogen atom or

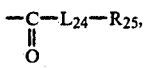

wherein $L_{24}$ is an oxygen atom or NH, and $R_{25}$ is a hydrogen atom or an alkyl group having from 1 to 10 carbon atoms. Particularly preferably $R_2$ is a hydrogen atom or

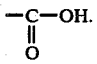

$R_3$ is preferably a hydrogen atom or an alkyl group having from 1 to 4 carbon atoms. Particularly preferably $R_3$ is a hydrogen atom or a methyl group.

$L_2$ represents a single bond, or a di- or a trivalent bonding group. Of these bonding groups, a single bond and divalent bonding group represented by the formula

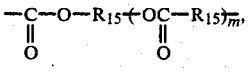

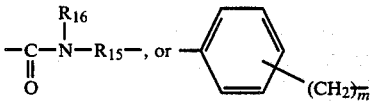

wherein $R_{15}$ represents an alkylene group having from 1 to 12 carbon atoms, an arylene group having from 6 to 18 carbon atoms, or an aralkylene group having from 7 to 20 carbon atoms, $R_{16}$ represents a hydrogen atom or an alkyl group having from 1 to 16 carbon atoms, and m is an integer of 0, 1, or 2 are preferred. Particularly preferably, $L_2$ represents a single bond, and a divalent bonding group represented by the formula

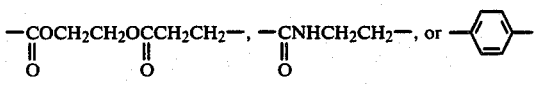

$X_1$ represents a hydrogen atom or a cation. Preferably, it is a hydrogen, sodium, or potassium.

n is preferably 1.

Component Z is a repeating unit resulting from copolymerization of an ethylenically unsaturated monomer copolymerizable with monomers constituting Components X and Y. It may contain two or more monomer units.

$R_4$ represents a hydrogen atom or a substituted or unsubstituted alkyl group having from 1 to 16 carbon atoms. Preferably $R_4$ represents a hydrogen atom or an alkyl group having from 1 to 4 carbon atoms, and particularly preferably a hydrogen atom or a methyl group.

$L_3$ represents a single bond, or a di- or a trivalent bonding group. Of these bonding groups, a single bond and a divalent bonding group represented by the formula

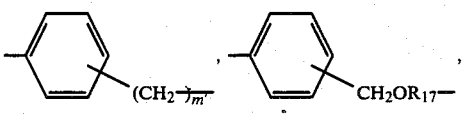

-continued $$-\underset{\underset{O}{\|}}{C}-O-R_{18}\text{-}(OR_{17})_{m'}\text{-}, \text{ or } -\underset{\underset{O}{\|}}{C}NH-R_{18}-$$

wherein $R_{17}$ and $R_{18}$, which may be the same or different, each represents an alkylene group having from 1 to 12 carbon atoms, arylene group having from 6 to 18 carbon atoms, or aralkylene group having from 7 to 20 carbon atoms, and m' is an integer of 0, 1, or 2, is preferred. Particularly preferably, $L_3$ represents a single bond, and a divalent bonding group represented by the formula.

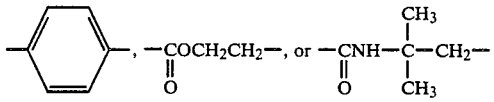

$X_2$ represents a hydrogen atom or a cation. It is preferably hydrogen, sodium, or pottasium.

n' is preferably 1.

x, y, and z each is an average number of added monomers, which is preferably from 0 to 50, provided that x, y, and z are not 0 at the same time. It is preferred that the total of x+y+z be 40 or less, provided that x, y, and z are not 0 at the same time. Particularly preferred is that each of x and (y+z) is from 1 to 15.

Q represents a hydrogen atom, an initiator residual group or a chain transfer agent residual group.

Preferred examples of the compounds represented by formula (I) are shown below. In the following formulae, the values of x, y, and z indicate the average number of units derived from respective monomers, but the compounds are not limited to the following combinations.

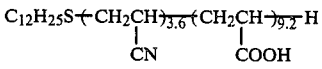

Compound (1)

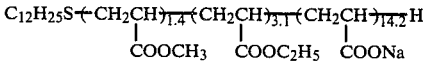

Compound (2)

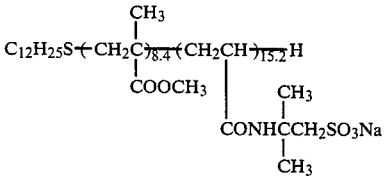

Compound (3)

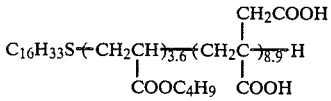

Compound (4)

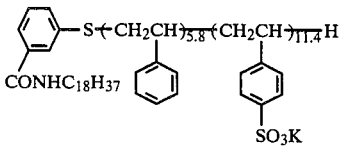

Compound (5)

-continued

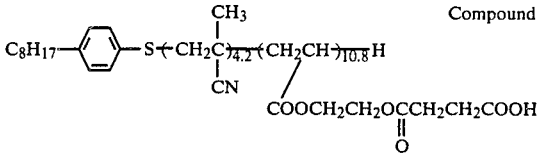

Compound (6)

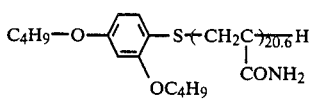

Compound (7)

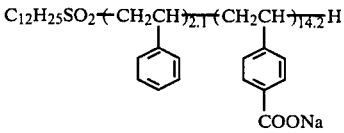

Compound (8)

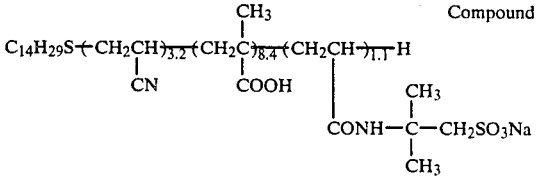

Compound (9)

Compound (10)

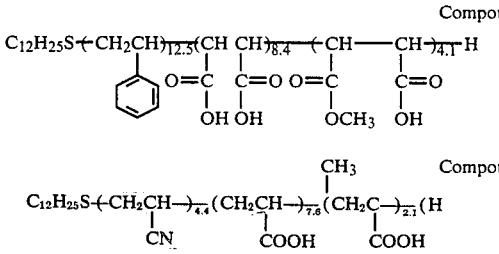

Compound (11)

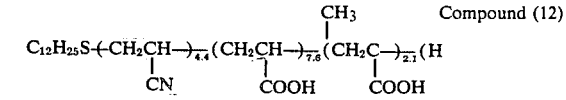

Compound (12)

The compounds of formula (I) have a much greater ability to decrease the surface tension than known polymeric surface active agents, e.g., compounds as described in Yamashita et al., *Abura Kagaku* (*Oil Chemistry*), Vol. 9, No. 7, page 337 (1960). Furthermore, their use prevents coating problems, such as repelling due to calcium ions, for example. Although the exact reasons why the compounds of formula (I) yield the above effects is not clear, it is believed that the effects are ascribable to the specific chemical structures of the compounds that a hydrophobic group as represented by $R_1$ is attached to the terminal and the main chain having a molecular weight falling within the oligomer range has hydrophilic side chains as represented by Component Y and/or Component Z, and also to the surface active behavior thereof.

The compounds of formula (I) can be prepared by radical polymerizing a mixture of at least one ethylenically unsaturated monomer of each of Components X, Y, and Z in the presence of a chain transfer agent. Chain transfer agents which can be used for this purpose are described, for example, in T. Ohtsu, *Koza Zyugo Hanno Ron* 1 "*Radical Polymerization* (*I*)", Kagaku Dozin Co., Ltd. (1971). This radical polymerization can be carried out by methods as described, for example, in T. Ohtsu & M. Kinoshita, *Kobunshi Gosei no Jikkenho* (Experimental Method in Polymer Synthesis), Kagaku Dozin Co., Ltd. (1972).

A preparation example of Compound (1) is described below.

PREPARATION EXAMPLE 1

Preparation of Compound (1)

150 ml of isopropanol and 0.93 g of $\alpha,\alpha'$-azobisisobutyronitrile as an initiator were placed in a 500 ml four-necked flask equipped with a stirrer, a reflux condenser, a thermometer, a dropping funnel, and a nitrogen-introduction tube and then heated to 70° C. while stirring. While maintaining the mixture at 70°-75° C., a solution consisting of 54.4 g of acrylic acid, 20.0 g of acrylonitrile, and 25.5 g of dodecylmercaptane was added dropwise thereto over 2 hours. After all of the solution was added, 0.31 g of $\alpha,\alpha'$-azobisisobutyronitrile was further added, and the resulting mixture was stirred for 3 hours while maintaining the temperature at 70°-75° C. The reaction mixture was added to 3 l of n-hexane, and a precipitate formed was dried under reduced pressure.

The compounds of formula (I) can be added to a hydrophilic organic colloid coating solution and used as coating aids. The amount of the compound used is preferably from 0.01 to 5 g, and more preferably from from 0.05 to 2 g per kilogram of the coating solution. The amount of the coating aid used is from 1 mg to 5 g, and preferably from 10 mg to 2 g per $m^2$ of a hydrophilic organic colloid layer.

As a hydrophilic organic colloid that can be used in the present invention, it is advantageous to use gelatin. In addition, other hydrophilic colloids can be used. Examples include proteins such as gelatin derivatives, graft polymers of gelatin and other polymers, albumin, and casein; sugar derivatives such as cellulose derivatives (e.g., hydroxyethyl cellulose, carboxymethyl cellulose, and cellulose sulfate), sodium alginate, and starch derivatives; and various hydrophilic synthetic polymers including homopolymers and copolymers, such as polyvinyl alcohol, polyvinyl alcohol partial acetal, poly-N-vinyl pyrrolidone, polyacrylic acid, polymethacrylic acid, polyacrylamide, polyvinyl imidazole, and polyvinyl pyrazole.

As gelatin, as well as lime-processed gelatin, acid-processed gelatin and enzyme-processed gelatin as described in *Bull. Soc. Sci. Phot. Japan,* No. 16, page 30 (1966) also can be used. In addition, hydrolyzates and enzyme decomposition products of gelatin can be used. Gelatin derivatives which can be used include reaction products of gelatin and various compounds such as acid halides, acid anhydrides, isocyanates, bromoacetic acid, alkanesultones, vinylsulfonamides, maleinimides, polyalkylene oxides, and epoxy compounds.

The hydrophilic organic colloid layer of the present invention is a photographic layer prepared by using a hydrophilic organic colloid as described above, particularly gelatin as a binder. Typical examples of such hydrophilic organic colloid layers include a silver halide emulsion layer, a surface protective layer, a filter layer, an inter layer, an anti-halation layer, an antistatic layer, a subbing layer, and a backing layer.

The compounds of formula (I) are preferably used in the formation of a hydrophilic organic colloid layer in which photographic additives that are only sparingly soluble in water are dissolved or dispersed in a high boiling organic solvent, because they have a high ability to dissolve the photographic additives and also high surface activity.

In the silver halide emulsion layer of the present invention, various silver halides can be used. Examples include silver chloride, silver bromide, silver chlorobromide, silver iodobromide, and silver chloroiodobromide. Preferred are silver iodobromide containing from 2 to 20 mol% of silver iodide and silver chlorobromide containing from 10 to 50 mol% of silver bromide. There are no special limitations to the crystal form, crystal structure, grain size, grain size distribution, etc., of the silver halide particles. Silver halide crystals may be single crystals or twins, and can have hexahedral, octahedral, or tetradecahedral crystal form. In addition, tabular grains having a thickness of about 0.5 micron, a diameter of at least 0.6 micron, and an average aspect ratio of at least 5 can be used as described in Research Disclosure 22534 (January, 1983).

The crystal structure may be uniform or different between the inner portion and the external portion, and may be in a layer structure. In addition, those in which silver halide particles having different compositions are bonded together by epitaxial bonding, and a mixture of silver halide particles having varied crystal forms may be used. Furthermore, silver halide particles may be such that a latent image is formed on the surface of the particle, or may be such that it is formed in the inner portion thereof.

Silver halide particles may be fine grains having a diameter of 0.1 micron or less, or large-sized particles having a projection area diameter of up to 3 microns. A single dispersion emulsion having a narrow distribution, or a polydispersion emulsion having a broard distribution may be used.

These silver halide particles can be produced by known techniques commonly used in the present field.

The above-described silver halide emulsion can be chemically sensitized by known techniques such as the sulfur sensitization method, the noble metal sensitization method, and a combination thereof. The silver halide emulsion of the present invention can provide color sensitivity in a desired wavelength region by the use of sensitizing dyes. Dyes which are preferably used for this purpose are methine dyes such as cyanine, hemicyanine, rhodacyanine, merocyanine, oxonol, and hemioxonol, and styryl dyes. These compounds can be used singly or in combination with each other.

Typical examples of photographic additives that are only sparingly soluble in water are oil-soluble color couplers, color foggants or antioxidants to be used to prevent color-mixing, color fade-preventing agents (e.g., alkylhydroquinones, alkylphenols, cumarons, and curomanes), hardening agents, oil-soluble filter dyes, oil-soluble ultraviolet absorbers, DIR (development inhibitor-releasing) compounds (e.g., DIR hydroquinones, and colorless DIR compounds), developers, dye developers, DRR (dye releasing redox) compounds, DDR couplers, etc.

As oil-soluble color couplers, benzoylacetanilide-, pivaroylacetanilide-, pyrazolone-, cyanoacetyl-, phenol-, and naphthol-based compounds can be used. Typical examples of these compounds are described in U.S. Pat. Nos. 2,875,057, 3,408,194, 3,582,322, 3,891,445, 2,600,788, 3,062,653, 3,311,476, 3,519,429, 3,558,319, 3,615,506, 3,834,908, 2,369,929, 2,474,293, 2,895,826, 3,591,383, 3,227,544, and 3,790,384.

High boiling organic solvents which can be used include phthalic acid alkyl esters (e.g., dibutyl phthalate and dioctyl phthalate), phosphoric acid esters (e.g., diphenyl phosphate, triphenyl phosphate, tricresyl phosphate, and dioctylbutyl phosphate), citric acid esters (e.g., tributyl acetylcitrate), benzoic acid esters (e.g., octyl benzoate), and alkylamides (e.g., diethyllaurylamide).

In addition, various additives useful for the photographic light-sensitive material, such as stabilizers, hardening agents, dyes, matting agents, light-sensitive silver halide particles, other surface active agents, polymer latexes, and brightening agents can be added to the hydrophilic colloid coating solution.

As other surface active agents which are used in combination with the compounds of formula (I), i.e., the surface active agents of the present invention, nonionic surface active agents are preferably used.

The above-described additives are described in *Product Licensing Index,* Vol. 92, pages 107–110 (December 1971), *Research Disclosure,* 15,162 (November 1976), and 17,643 (December 1978).

The hydrophilic organic colloid layer with the compound of formula (I) incorporated therein may contain a silver halide emulsion. The hydrophilic organic colloid layer may be permeable to water as in the silver halide emulsion layer, or may be permeable to silver halide as in the back layer. The compounds of formula (I) can be used in a photographic light-sensitive material bearing a single layer, not including a silver halide emulsion layer, or in coating a plurality of layers at the same time. In the above simultaneous multi-layer coating, the compound of formula (I) may be added to all coating solutions. It is preferred, however, that the compound of formula (I) be added to the uppermost layer or its adjacent layer, because it greatly reduces coating troubles and increases coating speed. Even in coating a coating layer not containing the compound of formula (I) on the coating layer containing the compound of formula (I), "repelling" can be reduced.

The simultaneous multi-layer coating can be carried out by techniques such as hopper coating as described in U.S. Pat. No. 2,761,417, curtain coating as described in U.S. Pat. No. 3,508,947, or methods as described in *Research Disclosure,* 17,644 (December 1978).

The present invention is described in greater detail with reference to the following examples.

EXAMPLE 1

1 kg of a silver chlorobromide emulsion (containing 100 g of gelatin per mol of silver halide) which had been prepared and aged by the usual method was diluted to three times with a 10% aqueous gelatin solution, and saponin was added in an amount of 2 g per kilogram of the above-prepared emulsion solution. Separately, a 5% aqueous solution was prepared, and an amulsion of tri-n-hexyl phosphate in gelatin (average particle diameter, 0.9 μm) was added to the 5% aqueous gelatin solution in a proportion of 18 ml (as tri-n-hexyl phosphate) per kilogram of the 5% aqueous gelatin solution. This solution was divided into four portions. To each portion, a coating aid as shown in Table 1 was added to prepare coating solution for the surface protective layer.

The surface tension of the coating solution was measured by the Milhelmy method (see E. Matijevic, *Surface and Colloid Science,* Vol. 1, pp. 124–128, Wiley Interscience (1969), for example).

The emulsion solution and the coating solution for the surface protective layer were simultaneously coated on a cellulose triacetate support by the slide hopper method to prepare Samples 1 to 4. Each sample was examined for the number of repelling spots per square meter.

The results are shown in Table 1.

TABLE 1

| Sample | Coating Solution for Surface Protective Layer: Coating Aid | Surface Tension (dyne/cm) | Number of Repelling Spots |
|---|---|---|---|
| 1 (Comparative Example) | Compound A* 0.4 g/kg coating solution | 34.2 | 30 |
| 2 (Comparative Example) | Compound B** 0.4 g/kg coating solution | 31.3 | 266 |
| 3 (Comparative Example) | Compound C** 0.4 g/kg coating solution | 33.1 | 9 |
| 4 (Example of the Present Invention) | Compound 1 of the present invention 0.4 g/kg coating solution | 28.1 | 2 |

*Compound A: $C_{12}H_{25}OCH_2CH_2OSO_3Na$

**Compound B: 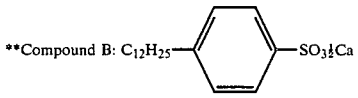

**Compound C: $C_{12}H_{25}OCH_2CH_2OSO_3\frac{1}{2}Ca$

It can be seen from Table 1 that Sample 4 (example of the present invention) has a lower surface tension of the coating solution and less repelling spots than Samples 1, 2 and 3 (comparative examples); Sample 4 is superior to Samples 1 to 3.

In Sample 2 using Compound B, the surface tension of the coating solution is low, but the number of repelling spots is markedly increased; thus, it can be seen that Sample 2 is not suitable for practical use.

In Sample 3 using Compound C, the number of repelling spots is low, but the surface tension is high; thus, it can be seen that Sample 3 is inferior in high-speed coating properties.

EXAMPLE 2

A mixture of 100 g of a yellow-forming coupler. α{3-[α-(2,4-di-tert-amylphenoxy)butylamido]benzoyl}-2-methoxyacetanlide, 52 ml of di-n-butyl phthalate, and 100 ml of ethyl acetate was added to 100 ml of an aqueous solution containing 3.75 g of sodium p-dodecylbezenesulfonate and then emulsified by the use of a homogenizer. Then, 400 g of the above-prepared emulsion was added to 1 kg of a photographic emulsion containing 34 g of silver chlorobromide (chlorine content, 7 mol%) and 40 g of gelatin, and 80 ml of a 2% aqueous solution of sodium 1-hydroxy-3,5-dichloro-S-triazine as a hardening agent was added thereto to prepare an emulsion coating solution.

Separately, to 1 kg of a 7% aqueous gelatin solution to which had been added 10 ml of a 2% aqueous solution of sodium 1-hydroxy-3,5-dichloro-S-triazine as a hardening agent, 0.5 g of a coating aid as shown in Table 2 was added to prepare a coating solution for the surface protective layer. This coating solution was measured for surface tension in the same manner as in Example 1.

The above-prepared emulsion coating solution and coating solution for the surface protective layer were coated at the same time on a cellulose triacetate support in dry thickness of 5 μm and 14 μm, respectively.

The thus-produced materials, Samples 5 to 7, were measured for the number of repelling spots per square meter. The results are shown in Table 2.

TABLE 2

| Sample | Coating Solution for Surface Protective Layer: Coating Aid | Surface Tension (dyne/cm) | Number of Repelling Spots |
|---|---|---|---|
| 5 (Comparative Example) | Compound D* | 28.6 | 7 |
| 6 (Comparative Example) | Compound E** | 27.9 | 4 |
| 7 (Example of the Present) Invention) | Compound (2) of the present invention | 26.4 | 0 |

Note:

*Compound D: $C_9H_{19}$— 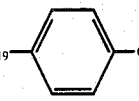 —$O(CH_2CH_2O)_3SO_3Na$

**Compound E: $C_9H_{19}$— 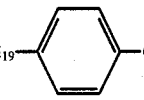 —$O(CH_2CH_2O)_3SO_3\frac{1}{2}Ca$

It can be seen from Table 2 that Sample 7 (example of the present invention) is lower in the surface tension of the coating solution and less repelling than Samples 5 and 6 (comparative examples); that is, Sample 7 is superior to Samples 5 and 6.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a hydrophilic organic colloid layer, wherein the hydrophilic organic colloid layer contains at least one compound represented by formula (I)

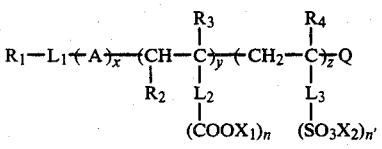

(I)

wherein $R_1$ represents a substituted or unsubstituted alkyl or aromatic group:

$R_2$ represents a hydrogen atom or $$-\underset{\underset{O}{\|}}{C}-L_4-R_5,$$

wherein $L_4$ represents a divalent bonding group, and $R_5$ represents a hydrogen atom or a substituted or unsubstituted alkyl or aromatic group;

$R_3$ and $R_4$ each represents a hydrogen atom, or a substituted or unsubstituted alkyl group;

$L_1$ represents a divalent bonding group selected from —S— and —$SO_2$—;

$L_2$ and $L_3$ each represents a single bond or a divalent or trivalent bonding group;

n and n' each represents an integer of 1 or 2;

A represents a repeating unit resulting from polymerization of an ethylenically unsaturated monomer copolymerizable with monomers constituting the units

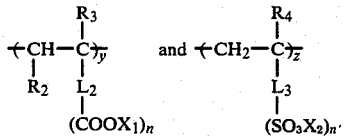

wherein $X_1$ and $X_2$ each represents a hydrogen atom or a cation;

x, y, and z are each an average number of units derived from respective monomers, with x being greater than 0 and at least one of y and z being greater than 0; and Q represents a monovalent group.

2. A silver halide photographic light-sensitive material as in claim 1, wherein $R_1$ represents a substituted or unsubstituted alkyl group having from 8 to 20 carbon atoms, or a group represented by forma (III)

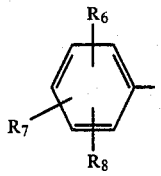

(III)

wherein $R_6$ and $R_7$ each represents a hydrogen atom, a halogen atom, a substituted or unsubstituted alkyl group having from 1 to 12 carbon atoms, or an alkoxyl group having from 1 to 10 carbon atoms, and $R_8$ represents a hydrogen atom or a group represented by formula (IV)

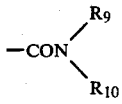

(IV)

wherein $R_9$ and $R_{10}$ each represents a hydrogen atom or a substituted or unsubstituted alkyl group having from 6 to 18 carbon atoms, or $R_9$ and $R_{10}$ together combine to form a nitrogen-containing ring.

3. A silver halide photographic light-sensitive material as in claim 1, wherein $R_1$ represents an alkyl group having from 8 to 12 carbon atoms, a group represented by formula (V)

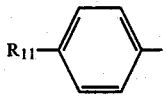

(V)

wherein $R_{11}$ represents an alkyl group having from 8 to 12 carbon atoms, a group represented by formula (VI)

(VI)

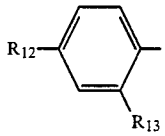

wherein $R_{12}$ and $R_{13}$ each represents an alkoxyl group having from 4 to 8 carbon atoms, or a group represented by formula (VII)

(VII)

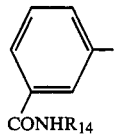

wherein $R_{14}$ represents an alkyl group having from 8 to 18 carbon atoms.

4. A silver halide photographic light-sensitive material as in claim 1, wherein and A is a repeating unit resulting from polymerization of an ethylenically unsaturated monomer selected from the group consisting of acrylonitrile, styrene, vinyl acetate, methyl methacrylate, methyl acrylate, n-butyl acrylate, and n-octyl acrylate.

5. A silver halide photographic light-sensitive material as in claim 1, wherein y is greater than 0;

$R_2$ represents a hydrogen atom or $$-\underset{\underset{O}{\|}}{C}-L_{24}-R_{25}$$

wherein $L_{24}$ is an oxygen atom or NH, and $R_{25}$ is a hydrogen atom or an alkyl group having from 1 to 10 carbon atoms;

$R_3$ is a hydrogen atom or an alkyl group having from 1 to 4 carbon atoms;

$L_2$ represents a single bond or a divalent bonding group represented by the formula $$-\underset{\underset{O}{\|}}{C}-O-R_{15}\left(-\underset{\underset{O}{\|}}{C}-R_{15}\right)_m,$$

$$-\underset{\underset{O}{\|}}{C}-\overset{\overset{R_{16}}{|}}{N}-R_{15}-, \text{ or } -\bigcirc-(CH_2)_m,$$

wherein $R_{15}$ represents an alkylene group having from 1 to 12 carbon atoms, an arylene group having from 6 to 18 carbon atoms, or an aralkylene group having from 7 to 20 carbon atoms, $R_{16}$ represents a hydrogen atom or an alkyl group having from 1 to 16 carbon atoms, and m is an integer of 0, 1, or 2;

$X_1$ represents a hydrogen or a cation; and n is 1.

6. A silver halide photographic light-sensitive material as in claim 1, wherein z is greater than 0;

$R_4$ represents a hydrogen atom or an alkyl group having from 1 to 4 carbon atoms;

$L_3$ represents a single bond or a divalent bonding group represented by the formula $$-\bigcirc-(CH_2)_m-, \quad -\bigcirc-CH_2OR_{17}-,$$

$$-\underset{\underset{O}{\|}}{C}-O-R_{18}\left(-OR_{17}\right)_{m'}-, \text{ or } -\underset{\underset{O}{\|}}{C}NH-R_{18}-$$

wherein $R_{17}$ and $R_{18}$ each represents an alkylene group having from 1 to 12 carbon atoms, an arylene group having from 6 to 18 carbon atoms, or an aralkylene group having from 7 to 20 carbon atoms, and m' is an integer of 0, 1, or 2, $X_2$ represents a hydrogen atom or a ration; and n' is an integer of 1.

7. A silver halide photographic light-sensitive material as in claim 4, wherein y is greater than 0;

$R_2$ represents a hydrogen atom or $$-\underset{\underset{O}{\|}}{C}-L_{24}-R_{25}$$

wherein $L_{24}$ is an oxygen atom or NH, and $R_{25}$ is a hydrogen atom or an alkyl group having from 1 to 10 carbon atoms;

$R_3$ is a hydrogen atom or an alkyl group having from 1 to 4 carbon atoms;

$L_2$ represents a single bond or a divalent bonding group represented by the formula $$-\underset{\underset{O}{\|}}{C}-O-R_{15}\left(-\underset{\underset{O}{\|}}{C}-R_{15}\right)_m,$$

$$-\underset{\underset{O}{\|}}{C}-\overset{\overset{R_{16}}{|}}{N}-R_{15}-, \text{ or } -\bigcirc-(CH_2)_m,$$

wherein $R_{15}$ represents an alkylene group having from 1 to 12 carbon atoms, an arylene group having from 6 to 18 carbon atoms, or an aralkylene group having from 7 to 20 carbon atoms, $R_{16}$ represents a hydrogen atom or an alkyl group having from 1 to 16 carbon atoms, and m is an integer of 0, 1, or 2;

$X_1$ represents a hydrogen or a cation; and n is 1.

8. A silver halide photographic light-sensitive material as in claim 4, wherein z is greater than 0;

$R_4$ represents a hydrogen atom or an alkyl group having from 1 to 4 carbon atoms;

$L_3$ represents a single bond or a divalent bonding group represented by the formula $$-\bigcirc-(CH_2)_m-, \quad -\bigcirc-CH_2OR_{17}-,$$

-continued $$-\underset{\underset{O}{\|}}{C}-O-R_{18}\left(OR_{17}\right)_{m'}-, \text{ or } -\underset{\underset{O}{\|}}{C}NH-R_{18}-$$

wherein $R_{17}$ and $R_{18}$ each represents an alkylene group having from 1 to 12 carbon atoms, an arylene group having from 6 to 18 carbon atoms, or an aralkylene group having from 7 to 20 carbon atoms, and m' is an integer of 0, 1, or 2, $X_2$ represents a hydrogen atom or a cation; and n' is an integer of 1.

9. A silver halide photographic light-sensitive material as in claim 1, wherein the sum of x+y+z is 40 or less.

10. A silver halide photographic light-sensitive material as in claim 8, wherein the sum of x+y+z is 40 or less.

11. A silver halide photographic light-sensitive material as in claim 8, wherein the sum of x+y+z is 40 or less.

12. A silver halide photographic light-sensitive material as in claim 9, wherein each of x and (y+z) is from 1 to 15.

13. A silver halide photographic light-sensitive material as in claim 10, wherein each of x and (y+z) is from 1 to 15.

14. A silver halide photographic light-sensitive material as in claim 11, wherein each of x and (y+z) is from 1 to 15.

* * * * *